United States Patent [19]

Beale et al.

[11] 4,183,214

[45] Jan. 15, 1980

[54] SPRING AND RESONANT SYSTEM FOR FREE-PISTON STIRLING ENGINES

[75] Inventors: William T. Beale; James G. Wood; David R. Gedeon, all of Athens, Ohio

[73] Assignee: Sunpower, Inc., Athens, Ohio

[21] Appl. No.: 793,915

[22] Filed: May 5, 1977

[51] Int. Cl.[2] ..... F02G 1/04

[52] U.S. Cl. ..... 60/520; 60/525

[58] Field of Search ..... 60/517, 518, 520, 525; 62/6

[56] References Cited

U.S. PATENT DOCUMENTS

| | | | |
|---|---|---|---|
| 3,487,635 | 1/1970 | Prast et al. | 60/520 |
| 3,552,120 | 1/1971 | Beale | 62/6 |
| 3,937,018 | 2/1976 | Beale | 60/520 |
| 4,058,382 | 11/1977 | Mulder | 62/6 |

*Primary Examiner*—Allen M. Ostrager
*Assistant Examiner*—Stephen F. Husar
*Attorney, Agent, or Firm*—Frank H. Foster

[57] ABSTRACT

A free-piston Stirling engine having a double acting, gas spring system for applying bi-directional, resilient spring forces to the displacer piston rod and also a free-piston Stirling engine having a displacer and power piston which are mechanically resonant at the operating frequency of the engine. The springing system is a gas containing compartment which is formed in communication with the effective end of the displacer rod. An adjustable spool valve arrangement may be formed in the mating walls of the displacer rod and its cylinder for connecting the gas containing compartment with the bounce space during a relatively minor interval of the displacer rod stroke intermediate its extremes for adjustably maintaining the mean position of the displacer at the position at which the interconnection occurs. The resonant system comprises the combination of a displacer and associated spring with the displacer mass and the spring force constant being such that the combination is resonant at the engine operating frequency. Similarly, the power piston may be linked to a gas or mechanically deformable spring wherein that combination is also resonant at the same operating frequency. Preferably, the displacer spring is a gas spring linked to the engine cylinder block. A balanced, multi-piston engine is described which has a power piston spring which comprises a mass of gas in a passage communicating with an end of each of the power piston cylinders.

9 Claims, 9 Drawing Figures

FIG. 8
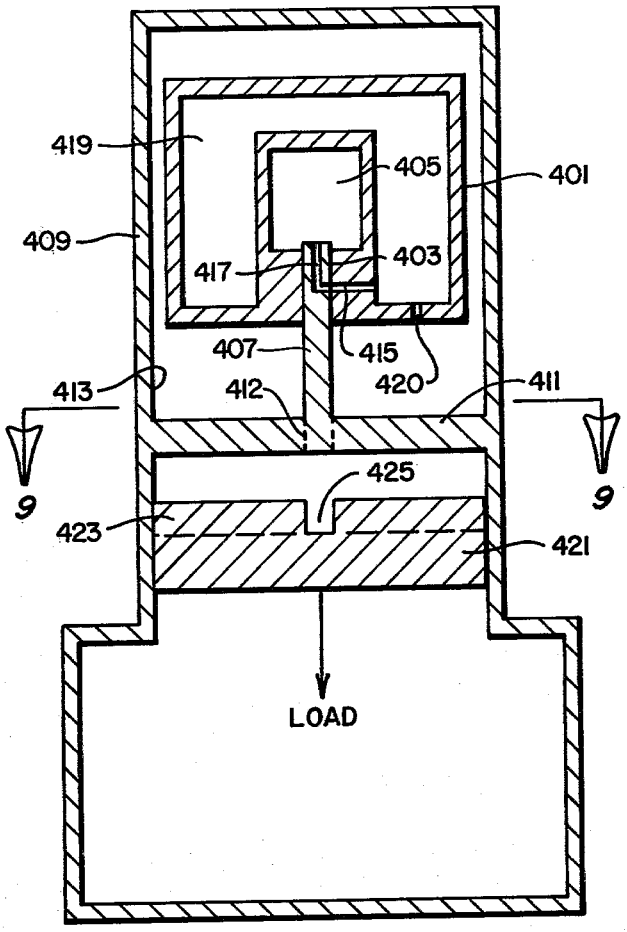
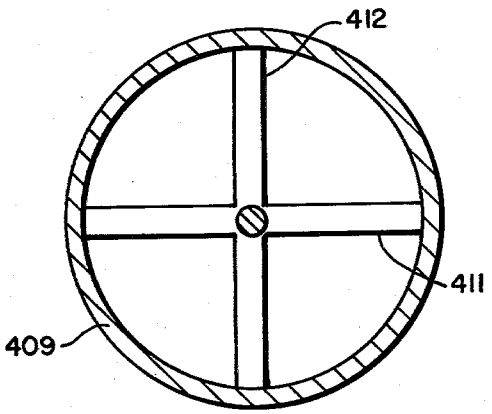
FIG. 9

SPRING AND RESONANT SYSTEM FOR FREE-PISTON STIRLING ENGINES

BACKGROUND OF THE INVENTION

The Stirling cycle engine has been known generally for decades and relies upon the pressure variations of a mass of working fluid confined in a work space. These pressure variations are caused by the alternate heating and cooling of the working fluid which is forced by a displacer piston between communicating hot space and cold space portions of the work space. One engine which offers advantages is the free-piston Stirling engine of the type illustrated and described in the U.S. patents of W. T. Beale U.S. Pat. Nos. 3,552,120; 3,645,649; and 3,828,558 and French Pat. Nos. 1,407,682 and 1,534,734. These engines require no synchronizing mechanical connection between their displacer piston and power piston.

In the free-piston Stirling engine, the displacer and power piston reciprocate at the same frequency but with position-time characteristics which are different and not in phase.

In order to minimize collision between the two pistons and between the displacer and the end wall of its cylinder and to provide some force in opposition to gravitational forces, a helical spring has in the past been linked to the displacer and connected between the end of the displacer rod and its cylinder housing. Such mechanical springs, however, suffer from several disadvantages. They tend to wear out by flaking, fatiguing and ultimately failing. In fact, such springs have demonstrated a higher than usual failure rate when used in the Stirling engine environment.

Mechanical springs are also inadequate for use in Stirling engines because each particular spring has a single force constant as determined by its material, geometrical configuration and Hooke's law. Because a free-piston Stirling engine may be initially charged within a broad range of working gas pressures, different mechanical springs are required for effective operation under different gas charge pressures.

Still another problem with mechanical springs is that they apply radially directed or side forces to the displacer rod in addition to the primary axial forces for which they are included in the engine. These side forces increase the static friction between the walls of the displacer rod and its slideably engaged cylinder and therefore impede the initial starting of such an engine.

Those springs which are used in the prior art engines have such small spring force constants that they have no significant effect on the frequency of operation or the operating characteristics of the engine. The frequency of operation and phase relationships in such engines are effectively a function of the mass and geometry of the displacer, power piston and cylinder housing and the characteristics of the working fluid. Consequently, during the operation of the conventional engine, it has been the pressure variations in the working space which primarily controlled the movement of the displacer and power piston.

It has always been a problem to start or initiate the oscillations of a free-piston Stirling engine because the conventional engine has a tendency to couple energy from the displacer to the power piston during any start up motion. This loss of displacer energy damps displacer operation and would more advantageously be used during start up to increase the amplitude of the displacer oscillations.

Additionally, it has in the past been impractical to vary the frequency of operation or other operating characteristics of prior art engines during their operation because their physical dimensions can not be conveniently varied without introducing substantial complexities into the engine.

Furthermore, multi-ended free-piston Stirling engines have in the past generated substantial mechanical vibration.

OBJECTS AND SUMMARY OF THE INVENTION

It is an object of the present invention to provide a double-acting or bi-directional springing system for a free-piston Stirling engine which eliminates the major sources for spring failure.

Another object of the present invention is to provide a springing system which has a characteristic force constant which is automatically varied in accordance with variations in the average operating pressure of a free-piston Stirling engine to maintain the proper phase relationships between the displacer and power pistons and to prevent their collisions.

Another object of the present invention is to provide a springing system which applies no side forces to the displacer rod and which maximizes the power output of the engine.

Still another object of the present invention is to provide a springing system which maintains and may additionally permit adjustment of the mean position of the reciprocating displacer.

Still asother object of the present invention is to provide a free-piston Stirling engine which starts more readily.

Another object of the present invention is to provide a free-piston Stirling engine which has a very stable operating frequency which is tunable.

Another object of the present invention is to provide a free-piston Stirling engine having a displacer and a power piston which are mechanically resonant and which may be tuned to an operating frequency for the engine.

Yet another object of the present invention is to minimize the vibration of a multi-ended free-piston Stirling engine.

Other objects and features of the invention will be apparent from the following specification and claims when considered in connection with the accompanying drawings illustrating the preferred embodiments of the invention.

In summary, the spring system of the invention is a gas-containing compartment which is formed in communication with the effective end of the displacer rod and has a sufficiently small volume, including the region into which the effective end of the displacer rod at times reciprocates, so that its contained gas exerts a pressure which is sufficient to apply substantial, bi-directional resilient forces on the displacer rod. The invention further includes the combination of a displacer and associated mechanical or gas spring wherein the displacer has a mass and the spring has a force constant such that the combination is mechanically resonant at the operating frequency of the engine.

DESCRIPTION OF THE DRAWINGS

FIG. 8 is a view in section taken substantially along the central axis illustrating an alternative embodiment of the invention in which the displacer is linked to the housing by a gas spring compartment formed in the displacer and a piston effectively comprising a rod fixed to the housing.

FIG. 9 is a view in section taken substantially along the line 9—9 of FIG. 8.

Figure 1:
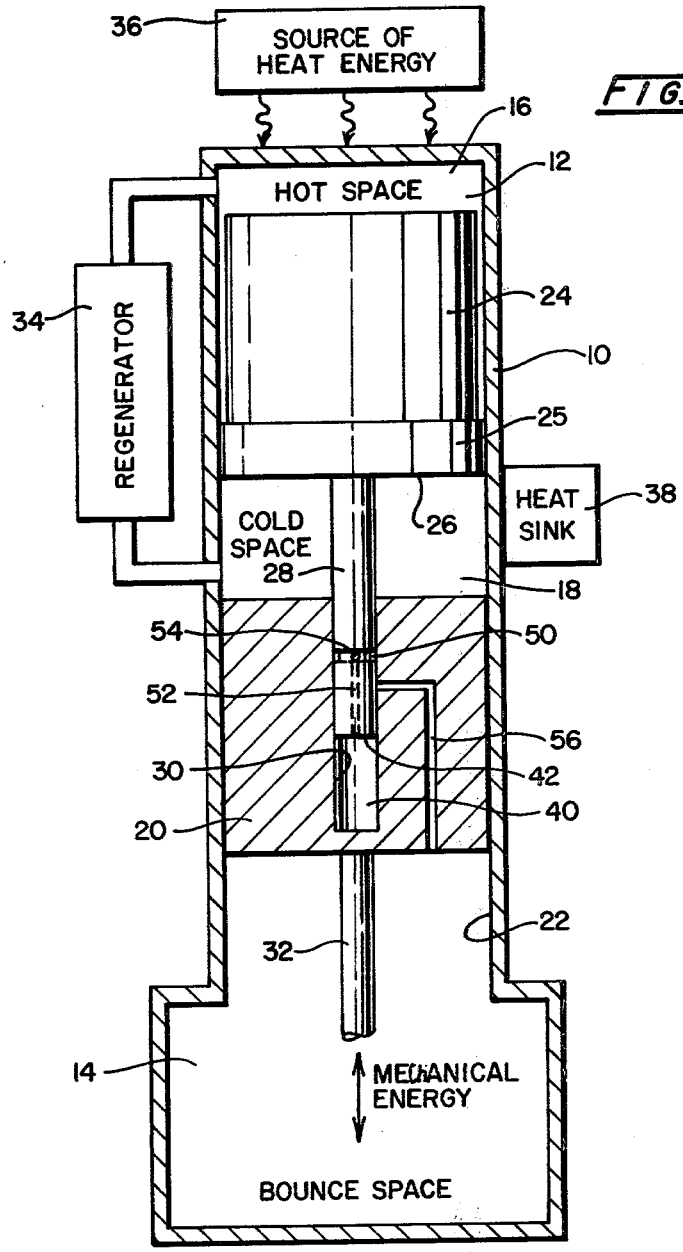
FIG. 1 is a diagramatic view of a free-piston Stirling engine embodying the spring system of the present invention and of the type in which the displacer rod extends axially into the power piston.

In describing the embodiments of the invention illustrated in the drawings specific terminology will be resorted to for the sake of clarity. However, it is not intended to be understood that each specific term includes all technical equivalents which operate in a similar manner to accomplish a similar purpose.

DETAILED DESCRIPTION

FIG. 1 illustrates a free-piston Stirling engine having a housing 10 enclosing a work space 12 and a buffer or bounce space 14. A bounce space contains a sufficiently large volume of gas such that its pressure variations are relatively small and have a relatively insignificant effect of engine operation. The work space 12 may be subdivided further into a hot space 16 and a cold space 18. These spaces are filled or charged with a gas, such as air or hydrogen, which is suitable for use in the Stirling engine.

The work space 12 is separated from the bounce space 14 by a power piston 20 which is reciprocally mounted in a power piston cylinder 22. A displacer piston 24, having a relatively small mass but a substantially volume and having a seal 25, is reciprocally slideable in a displacer cylinder 26 formed in the work space 12.

A displacer rod 28 is connected at one end to the displacer 24 and is sealingly slideable for reciprocation within a displacer rod cylinder 30 conveniently formed axially in the power piston 20. A power piston rod 32 is fixed to the power piston 20 to output mechanical energy to an electrical generator, hydraulic pump or other device.

A regenerator 34 may be provided for enhancing the operation of the engine in a manner well known in the art.

The structure of FIG. 1 is operated as an engine or motor by the application of heat from a heat source 36 to the associated hot space 16 and the removal of heat from the cold space by means of a heat exchanger or heat sink 38. As is well known in the prior art, devices of the type generally described above may also be operated as refrigeration and heating devices or for other heat pump applications by applying reciprocating mechanical energy to the power piston rod 32. It should therefore be understood and is intended that the structures of the present invention may be used advantageously in all these modes of operating a Stirling cycle device.

A gas containing compartment 40 is formed in the power piston 20 in communication with the effective end 42 of the displacer rod 28. The term "effective" is used because it is possible to mechanically connect the displacer through various linkages to accomplish an equivalent result. The gas-containing compartment 40 is formed to have a sufficiently small volume, including that region of the compartment 40 into which the effective end 42 of the displacer rod at times reciprocates, to provide substantial pressure variations within the compartment 40. The gas in the compartment 40 is bi-directional in that it is in compression during one portion of the stroke and expansion during the opposite portion of the stroke. Therefore it applies substantial resilient forces on the displacer rod alternately in opposite directions to provide a bi-directional resilient means with force characteristics which are analogous to the bi-directional force characteristics of a helical spring.

A spool valve arrangement is provided in order to control the mean pressure within the compartment 40 and preferably to maintain the mean pressure of the compartment 40 equal to the mean pressure of the bounce space 14.

The spool valve is formed generally so that it has a first port in communication with the compartment 40 and a second port in communication with either the work space or the bounce space and preferably with the bounce space 14. The valve is designed to open during a relatively minor interval of the stroke of the displacer rod 28 relative to the power piston 20 at a position which is intermediate the extremes of the stroke. Consequently, during this brief open interval, gas may pass through the valve tending to equalize the pressures within the compartment 40 and the space to which it is briefly connected.

Figure 2:
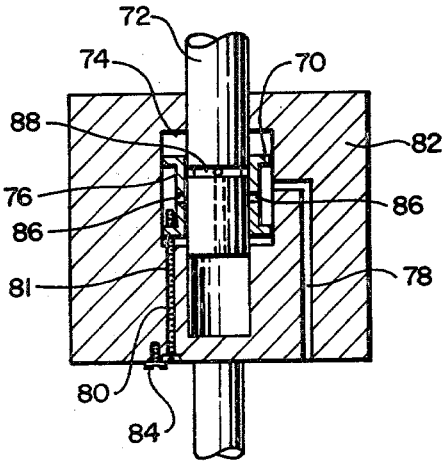
FIG. 2 is a diagram illustrating an alternative embodiment of the invention similar to FIG. 1 but in which the mean position of the displacer piston may be adjusted.
Figure 3:
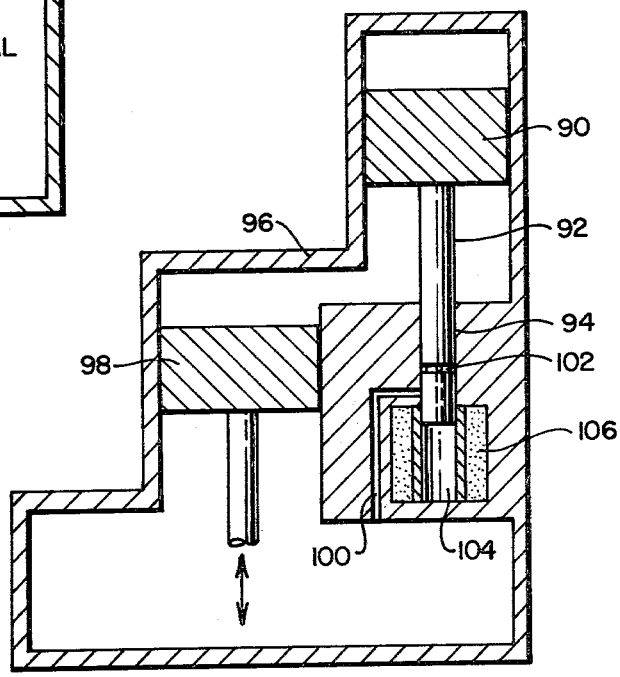
FIG. 3 is a diagramatic view of a free-piston Stirling engine in which the displacer rod extends into the engine housing rather than into the power piston.

In FIG. 1, and similarly in FIGS. 2 and 3, the valve is provided by forming in the displacer rod 28 an annular groove 50, which is connected by an axial passageway or bore 52 and a radial or cross bore 54 to the compartment 40. A second passageway 56 is formed from the displacer rod, cylinder wall 30 into communication with the bounce space 14.

During operation of the engine, the reciprocation of the displacer rod 28 in its cylinder 30 will cause the annular groove 50 to pass through an interval of registration so that gas may flow between the compartment 40 and the bounce space 14 to equalize their pressure. Consequently, the axial positioning of the annular groove 50 and the port through which the passageway 56 opens into the displacer rod cylinder 30 are both chosen so that this registration occurs at an intermediate position between the extremes of the relative reciprocation.

FIG. 2 illustrates an adjustable valve which permits the axial position at which registration occurs to be varied in order to control the position at which the pressure equalization occurs and thereby control the mean position of the displacer.

Although a great variety of such axially adjustable devices can be constructed within the spirit of the present invention, FIG. 2 illustrates a ring 70 sealingly but slidably engaged against a displacer rod 72 and mounted against the interior wall of a circular groove 74 formed in the power piston 82. The ring 70 is itself provided with an outer circular groove 76 which is held in communication with a passageway 78 over a range of axial positions within the groove 74. A plurality of circularly spaced radial ports 86 are formed through the wall of the ring 70.

The ring 70 may be axially adjusted and retained in its adjusted position by means of an adjustment 80 which slides in a bore 81 through the power piston 82 but threadedly engages the ring 70. The adjustment screw 80 is retained in the power piston 82 by a retaining screw 84 which is threadedly engaged to the power piston 82.

Consequently, by rotating the screw 80 and adjusting the axial position of the ring 70, the position of registration of the radial ports 86 with a groove 88 formed in the displacer rod 72 may be axially adjusted. This in turn permits centering or adjustment of the mean position of the displacer rod 72 relative to the power piston 82.

FIG. 3 illustrates a free-piston Stirling engine having a displacer 90 and displacer rod 92 which reciprocates within a cylinder 94 formed in the housing 96 rather than in the independent power piston 98. While this system illustrated in FIG. 3 may also be provided with a centering adjustment structure such as that illustrated in FIG. 2, a simple passageway 100 is illustrated for at times communicating with a groove 102 formed in the displacer rod 92 which communicates with a gas containing compartment 104 formed in the housing 96. As an alternative embodiment of the invention, a porous solid 106 may be provided within the compartment 104 in order to reduce the hysteresis loss within the gas springing system.

Because different spring constants may be desired under different conditions and are dependent upon such factors as the mass of the displacer and power pistons, the gas and its pressure and motor loading, the particular volume of the gas containing compartment in each embodiment of the invention may be determined during the design of a particular engine using the well known gas laws to provide the spring constant which is appropriate for the particular device.

If the gas charge pressure of a particular embodiment of the present invention is changed, the compartment 40 is rapidly charged with the appropriate quantity of gas so that its mean pressure will again equal the mean pressure of the bounce space. Consequently, the force constant provided by the structure of the present invention is automatically modified and to compensate for such pressure variations.

Figure 4:
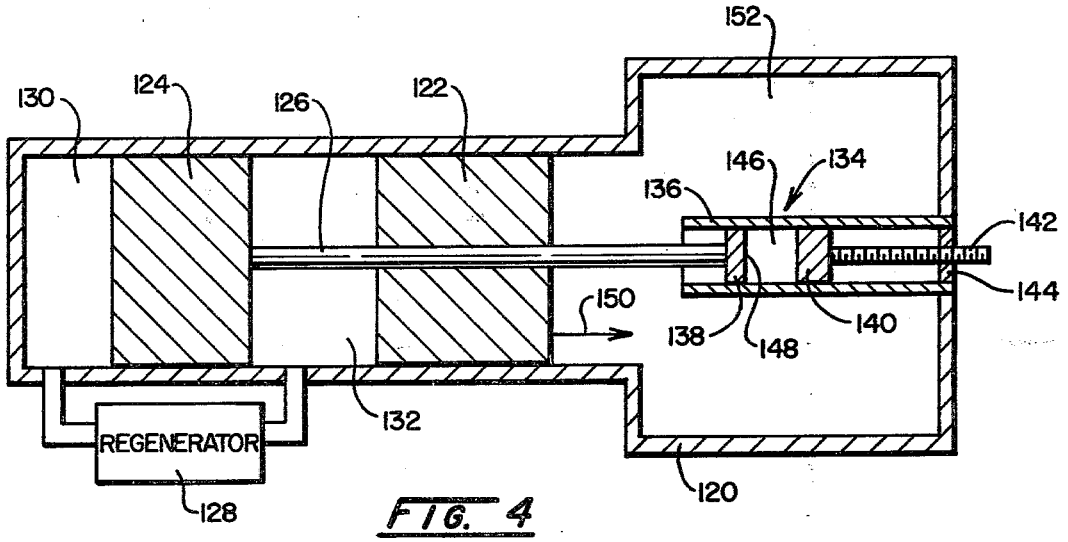
FIG. 4 is a diagramatic view of a free-piston Stirling engine wherein the displacer is tunably resonant by means of a gas spring system.

The free-piston Stirling engine diagramatically illustrated in FIG. 4 includes a cylinder housing 120, power piston 122, a displacer 124 connected to an associated displacer rod 126, a conventional regenerator 128 connected between a hot space 130 and a cold space 132 and a bounce space 152. The displacer rod 126 is connected to a bi-directional resilient means indicated generally as 134 which is in turn linked to the cylinder block 120. The terms "connected" or "linked" are not limited to direct connection of one part to another but are also intended to include connection through intermediate linkages where such connection would be recognized as being equivalent by those skilled in the art.

The particular resilient means 134 illustrated in FIG. 4 is a gas spring structure having a cylinder 136 which contains a first piston 138 connected to the end of the displacer rod 126. A second piston 140 is also sealingly slideable within the cylinder 136 and is connected to a rod 142 which is in turn threadedly engaged within a cap 144 so that rotation of the rod 142 will permit the piston 140 to be axially adjusted and retained in a position along and within the cylinder 136. Therefore, the cylinder 136, along with the pistons 138 and 140, defines a gas containing compartment having a sufficiently small volume that its contained gas exerts substantial resilient forces upon the displacer.

The volume of this gas containing compartment 146 may be adjusted by changing the axial position of the piston 140. Such adjustment of the volume of the gas containing compartment consequently permits the force constant of its contained gas to be varied. Such a gas spring resilient means advantageously may also include the valve means for centering the average position of the displacer which is illustrated in FIGS. 1 through 3.

In accordance with the principles of the present invention, the displacer 124 and the resilient means 134 are designed so that the mass of the displacer 124 and the force constant of the resilient means 134 provide a combination which is mechanically resonant at an operating frequency of the engine. This same resonant relationship may be accomplished using a mechanical spring substituted for the gas spring resilient means 134. Such a substitution, however, would result in loss of adjustability as well as a loss of the other advantages of the gas spring which have been described above.

The mathematical definition of the resonance condition is:

$$f=(1/2\pi)\sqrt{K/M} \quad (1)$$

where:

f is the resonant frequency in Hz

K is the spring force constant in Newtons per meter

M is the effective mass of the piston (includes any mass moving with the piston) in Kilograms Where a gas spring arrangement is used, such as described above and preferred, the spring force constant is given by the following:

$$K=\gamma P_0(A^2/V) \text{ (for gas spring)} \quad (2)$$

where:

$\gamma$ is the adiabatic constant for the gas in the engine. ($\gamma=1.67$ for Helium and $=1.4$ for air)

A is the effective end area of the gas spring piston (e.g., the end surface 148 of FIG. 4.) in square meters.

V is the volume of the gas containing compartment (e.g., compartment 146 of FIG. 4) in cubic meters.

Of course the above equations may be suitably modified for other gas spring structures such as an enclosed bellows.

Mechanical energy may be applied to or delivered from the engine of FIG. 4 by suitable mechanical connection, illustrated diagramatically at 150, to the power piston 122 such as described above.

Figure 5:
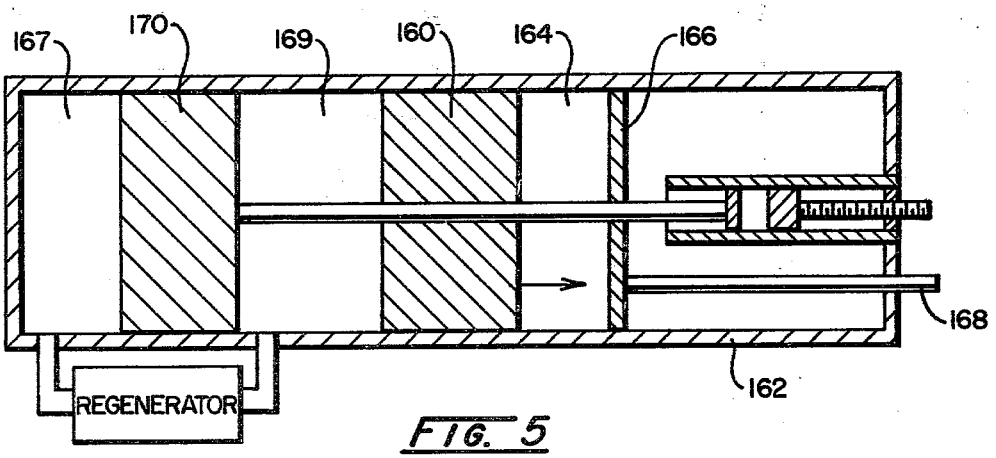
FIG. 5 is a diagramatic view of a free-piston Stirling engine similar to FIG. 4 but wherein the power piston is tunably resonant by means of a gas spring system.

FIG. 5 diagramatically illustrates a free-piston Stirling engine similar to the engine of FIG. 4 but modified to eliminate the bounce space 152 shown in FIG. 4 and to provide instead a second, bi-directional, resilient means linking the power piston 160 to the cylinder block or housing 162. The illustrated resilient means of FIG. 5 is an adjustable gas spring arrangement similar to that associated with the displacer in FIGS. 1–4. This gas spring includes the gas containing compartment 164 having a volume which is adjustable by virtue of a sealingly slideable piston 166 which is connected to an adjustment rod 168 for adjusting the volume of the gas containing compartment 164 and thereby to permit tuning of the resonant frequency of the power piston 160.

Consequently in the engine of FIG. 5 both the resonant frequency of the displacer piston 170 and the resonant frequency of the power piston 160 may be adjustably varied and tuned to substantially the same frequency. Of course, if a helical or other mechanical spring is used with either piston, it may be designed to provide resonance at a particular frequency and the other piston may then be tuned to that resonant frequency by means of the tunable gas spring arrangement.

Figure 6:
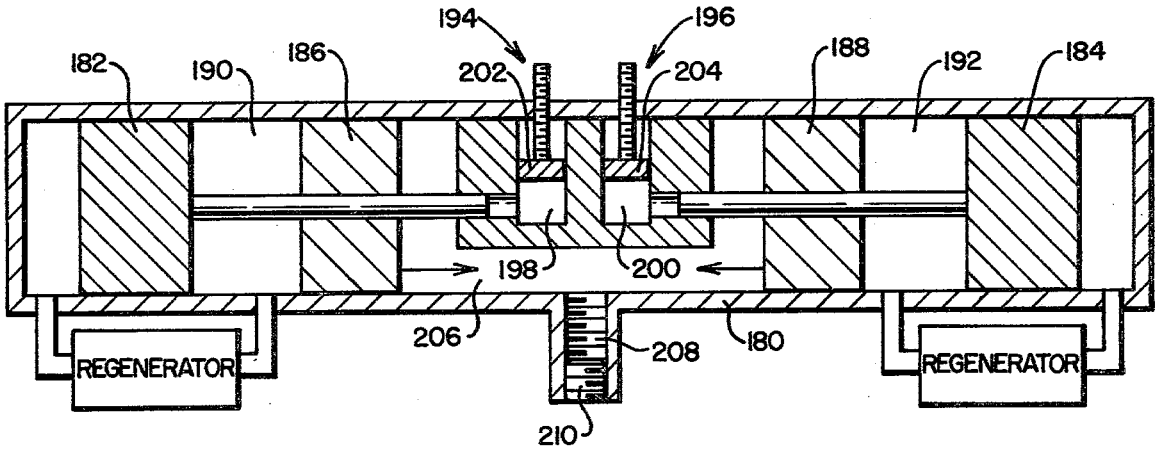
FIG. 6 is a diagramatic view of a double acting free-piston Stirling engine embodying the present invention.

FIG. 6 illustrates a free-piston Stirling engine embodying the present invention which is multi-ended and which operates with a phase relationship giving balanced oscillations of its pistons to thereby cancel or minimize net vibration of the engine.

This is essentially accomplished by linking the power pistons together with a bi-directional resilient means having a force constant which makes the two power pistons mechanically resonant substantially at the operating frequency of the engine.

The engine illustrated in FIG. 6 comprises a cylinder block or housing 180 having a pair of opposite and symmetrically arranged displacers 182 and 184 and opposite and symmetrically arranged power pistons 186 and 188. Each of the displacers 182 and 184 operate in their own work space 190 and 192 respectively and each power piston is in communication at one of its ends with a different one of the work spaces.

Each of the displacers 182 and 184 is linked to the cylinder block housing 180 by means of its own, different associated bi-directional resilient means 194 and 196 respectively. The bi-directional resilient means illustrated in FIG. 6 comprises gas springs of the type described above which have gas-containing compartments 198 and 200 which are adjustable by means of the sealingly slideable pistons 202 and 204, similar to the adjustments described above.

Although the power pistons 186 and 188 could be linked together by a helical or other mechanical spring, they are preferably linked together as illustrated in FIG. 6 by a mass of gas-contained in the entirety of the volume which is in communication between the ends of the power pistons 186 and 188. This communicating volume, referred to as the communicating passage 206 between the power pistons, includes portions of the cylinders in which the power pistons 186 and 188 reciprocate, all communicating passageways between the cylinders and any compartments in communication therewith.

The total volume of the passage 206 may of course be varied by various structures for tuning the resonant frequency of the power pistons 186 and 188. For example, a compartment 208 may be formed in communication with the passage 206 and have formed therein a threadedly engaged plug 210 which can be rotated to vary its axial position within the compartment 208 and thereby vary the total volume of the passage 206.

Figure 7:
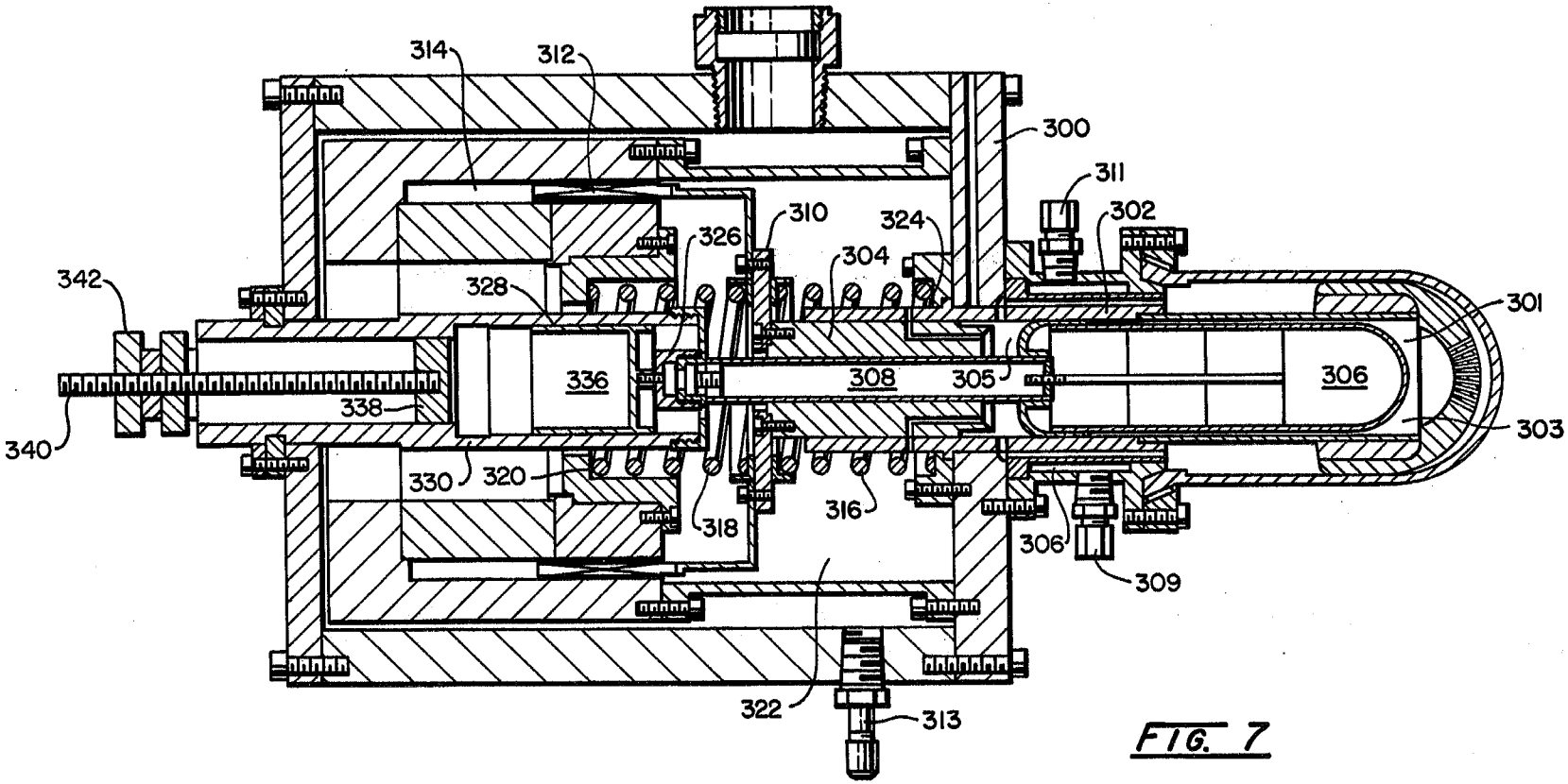
FIG. 7 is a view in section taken along the central axis showing a free-piston Stirling engine embodying the present invention.

FIG. 7 is a detailed illustration of a Stirling engine embodying the present invention. Many of the parts mentioned in the following description are actually subassemblies, each consisting of several more detailed parts. In many cases the parts of these subassemblies are not described in detail because they are not essential to the understanding of the present invention.

The engine of FIG. 7 includes a cylinder block housing 300 having a work space 301 including hot space 303 and cold space 305. The work space 301 is defined in part by a cylinder 302 which has a power piston 304 reciprocating at one end and a displacer 306 reciprocating at its opposite end. The displacer 306 has a displacer rod 308 both of which are hollow to minimize their mass.

An annular cooling fluid jacket 307 surrounds the cold space 305. Cooling fluid is circulated through the jacket 307 through inlet and outlet connectors 309 and 311. Working fluid such as air or helium is charged into the engine through a check valve connector 313.

The power piston 304 has a mounting plate 310 bolted thereto which is in turn connected to a linear alternator armature 312. During operation of the engine the alternator armature 312 reciprocates in a magnetic flux gap 314 in order to generate an electrical current.

The power piston 304 is linked to the cylinder housing 300 by means of a bi-directional resilient means 316. The bi-directional resilient means illustrated in FIG. 7 consists of a first helical spring 318 extending between the mounting plate 310 and an annular shoulder 320 formed in a portion of the housing 300 and a second helical spring 322 extending between the opposite side of the mounting plate 310 and a second annular shoulder 324 also formed on a portion of the housing 300.

The displacer rod 308 is connected through an articulated joint 326 to a hollow piston 328. The hollow piston 328 and the surrounding cylinder 330 within which the piston 328 sealingly slides form a gas spring arrangement of the type described above. The articulated joint 326 prevents binding of the displacer 306 and the piston 328 which might otherwise occur if their associated cylinder walls are not identically aligned.

The interior gas containing compartment 336, which forms a part of the bi-directional resilient means connecting the displacer 306 to the cylinder block housing 300, has a volume which is adjustable by means of the slideable piston 338. The piston 338 is adjustable by rotation of the threaded rod 344 which is threadedly engaged to the cap 342.

FIGS. 8 and 9 illustrate another means for linking the displacer to the housing. In FIG. 8, the displacer 401 has no piston rod fixed to itself but rather has a cylindrical bore 403 and a communicating gas containing compartment 405 formed therein.

A rod 407 is fixed to the housing 409 and has a portion effectively forming a piston which is slideable in the cylindrical bore 403. In particular, the rod 407 is mounted to a pair of cross beams 411 and 412, the ends of which are fixed to cylinder wall 413. For maintaining the central position of the displacer 401 a passage 415 is formed in the displacer 401 and another passage 417 is formed through the rod 407 into communication with the relatively large interior hollow 419 of the displacer 401. The interfacing ends of these passages 415 and 417 pass through a central or midstroke interval of registration in the manner described above. A very small vent hole 420 in the displacer communicates with the work space within cylinder 413. In this manner, the hollow 419 in the displacer is maintained at the average work space pressure and is able to maintain the average pressure in the compartment 405 to maintain proper centering.

The power piston 421 has a pair of cross slots 423 and 425 to permit free entry of the crossbeams 411 and 412 without collision.

One major advantage of the tuned embodiments of the present invention is that they exhibit improved self starting characteristics. In a conventional, free-piston, Stirling engine some energy is coupled to the power piston during initial start up taking energy away from and thereby damping the displacer oscillations. This energy could be used more effectively during start up to increase the amplitude of oscillations of the displacer.

In a tuned embodiment of the present invention, any slight disturbance or perturbation will initiate motion of the displacer and begin its oscillation at its natural frequency. Such oscillation of the displacer can begin and can increase in amplitude without requiring any power piston motion. Therefore the entirety of the energy increase is used to increase the amplitude of the displacer oscillations without these oscillations being damped out by power piston motion.

It may be noted additionally that there is a positive feedback of energy resulting from any power piston motion which will eventually occur and which further reinforces displacer oscillation. This positive feedback occurs because any motion of the power piston will cause any opposite reaction or recoil by the cylinder block housing. Such motion of the cylinder block housing in one direction has the same relative effect as motion of the displacer in the opposite direction.

Referring, for example, to the embodiment illustrated in FIG. 5, if we hypothetically initialize that the displacer 170 begins moving away from the hot space 167 toward the cold space 169 as a result of a pressure increase in the work space from heating of the working fluid, this increased working fluid pressure would tend to move the power piston 160 away from the hot space or to the right in FIG. 5. Such movement of the power piston 160 to the right would cause a reaction of the cylinder block housing 162 moving slightly to the left. This movement of the cylinder block housing 162 toward the left has the same effect relative to the displacer 170 as the displacer 170 moving to the right.

By springing the displacer to the cylinder block housing, the frequency of oscillation will remain very stable because it is not significantly influenced by temperature or pressure variations of the working fluid or engine loading. Instead, it is determined primarily by the relationship of the displacer mass and the force constant of its springing system.

So long as loading does not become too extreme, the damping effect of such loading will have an insignificant effect upon the operating frequency. This can be readily appreciated by those skilled in the art. The effect of damping on the resonant frequency of a mechanically resonant system is discussed in a text book entitled *Mechanics* by J. L. Meriam, published by John Wiley & Sons, Inc., 1959.

In those embodiments of the invention in which both the power pistons and the displacer are independently tuneable, both may be tuned to the same operating frequency. However, if only one is tuneable, the other may be designed for a particular operating frequency with the tuneable one being subsequently tuned to the actual natural frequency of the untuneable one.

It might be further noted that, under optimal conditions, the natural frequency of oscillation of the power piston may be slightly different from the natural frequency of the displacer and the operating frequency of the engine. Of course, the actual operating frequency of the displacer and power piston are identical.

The reason for this difference is that the engine should run with a phase difference by which the power piston lags the displacer. This is accomplished by having the natural frequency of the power piston approximately 1% to 3% below the natural frequency of the displacer. The engine will then operate at substantially the natural frequency of the displacer with the proper phase.

Because the actual natural frequency variation is dependent upon so many factors, such as damping factors, loads, pressure and temperature and because engines can't initially be designed and built to such precision, it is desirable to use at least one frequency adjustment such as those described above and then make fine adjustments after construction and during operation to make the engine operate properly.

It is to be understood that while the detailed drawings and specific examples given describe preferred embodiments of the invention, they are for the purpose of illustration only, that the apparatus of the invention is not limited to the precise details and conditions disclosed, that various changes may be made therein without departing from the spirit of the invention which is defined by the following claims.

We claim:

1. An improved, multiple ended, free-piston Stirling engine of the type having a housing defining symmetrically arranged work spaces each work space having a displacer cylinder formed therein said engine further including, a pair of symmetrically arranged, power piston cylinders each in communication at one end with a different one of said work spaces, wherein the improvement comprises:

(a) a plurality of displacers each reciprocally mounted in a different one of said displacer cylinders and each linked to said housing by a different bi-directional resilient means, wherein the mass of each displacer and the force constant of its associated resilient means are such that they are mechanically resonant substantially at an operating frequency of said engine; and (b) a plurality of power pistons sealingly slideable in said power piston cylinders, said power pistons being linked to each other by a third, bi-directional, resilient means wherein the mass of said power pistons and the force constant of the resilient means are such that they are mechanically resonant substantially at said operating frequency.

2. An improved, multiple ended, free-piston Stirling engine of the type having a housing defining symmetrically arranged work spaces each work space having a displacer cylinder formed therein, said engine further including a pair of symmetrically arranged, power piston cylinders each in communication at one end with a different one of said work spaces, wherein the improvement comprises:

(a) a plurality of displacers each reciprocally mounted in a different one of said displacer cylinders and each linked to said housing by a different bi-directional resilient means, wherein the mass of each displacer and the force constant of its associated resilient means are such that they are mechanically resonant substantially at an operating frequency of said engine; and (b) a plurality of power pistons sealingly slideable in said power piston cylinders, said power pistons being linked to each other by a third, bi-directional, resilient means wherein the mass of said power pistons and the force constant of the resilient means are such that they are mechanically resonant substantially at said operating frequency wherein said power piston cylinders are in communication with each other through a passage at their ends which are opposite to the ends in communication with said work spaces and wherein the resilient means linking said power pistons comprises a mass of gas in the communicating passage between said power pistons.

3. An engine according to claim 2 wherein each of the resilient means linking a displacer to the housing comprises a mass of gas confined in a gas containing compartment, said compartment having a sufficiently small and variable volume so that upon reciprocation of said displacer said gas exerts a substantial resilient force upon said displacer.

4. An improved, free-piston, Stirling engine of the type having a displacer reciprocally mounted in a work space and having a displacer rod connected at one end to the displacer and sealingly slideable in a displacer cylinder, said engine also having a power piston reciprocally mounted in a power piston cylinder in communication at one end with said work space, wherein the improvement comprises:

(a) a gas containing compartment formed in communication with the effective opposite end of said displacer rod and having a sufficiently small volume including the region into which said opposite end of said displacer rod at times reciprocates so that the gas in said compartment exerts a pressure which is sufficient to apply substantial, resilient forces on said displacer rod; and (b) a valve means having a first port in communication with said compartment and its second port in communication with one of the spaces of said engine, said valve means including means for opening said valve for a relatively minor interval of the stroke of said reciprocation intermediate the extremes of said reciprocation for maintaining a mean pressure in said compartment.

5. An engine according to claim 4 wherein a bounce space is provided in communication with the other end of the power piston and said second port is in communication with said bounce space.

6. An engine according to claim 4 wherein said valve means is adjustable for varying the axial position of said minor interval along said stroke.

7. An engine according to claim 4 wherein said valve means comprises a pair of relatively slideable port means one formed on said displacer rod in communication with said compartment and the other formed on said displacer rod cylinder in communication with one of the spaces of said engine.

8. An engine according to claim 4 wherein said displacer rod extends into the interior of said power piston and said compartment is formed within said power piston.

9. An improved, free-piston, Stirling engine of the type having a displacer reciprocally mounted in a work space and having a displacer rod connected at one end to the displacer and sealingly slideable in a displacer cylinder, said engine also having a power piston reciprocally mounted in a power piston cylinder in communication at one end with said work space, wherein the improvement comprises:

a gas containing compartment formed in communication with the effective opposite end of said displacer rod and having a sufficiently small volume including the region into which said opposite end of said displacer rod at times reciprocates so that the gas in said compartment exerts a pressure which is sufficient to apply substantial, resilient forces on said displacer rod wherein said compartment is provided with a porous solid for reducing hysteresis loss.

* * * * *